United States Patent [19]

Perlant

[11] Patent Number: 4,984,759

[45] Date of Patent: Jan. 15, 1991

[54] CONTAINER SUPPORT WITH IMPROVED BAG HOLDING MEANS

[76] Inventor: Sigmund Perlant, 1332 NW. 14 Ave., Pompano Beach, Fla. 33069

[21] Appl. No.: 326,765

[22] Filed: Mar. 21, 1989

[51] Int. Cl.[5] ..... B65B 67/04; A47F 5/00

[52] U.S. Cl. ..... 248/99; 248/235; 248/250; 211/90; 108/152; 108/108

[58] Field of Search ..... 248/95–101, 248/235, 251, 252, 247; 108/108, 152; 211/90, 186

[56] References Cited

U.S. PATENT DOCUMENTS

| | | | |
|---|---|---|---|
| 774,968 | 11/1909 | McKee | 248/251 |
| 1516,451 | 11/1924 | McKenzie | 248/97 |
| 2,875,970 | 6/1956 | Gardner . | |
| 2,900,085 | 8/1959 | Levy | 248/250 X |
| 3,284,040 | 11/1966 | Marontate | 211/90 X |
| 3,484,816 | 12/1969 | Boss | 108/152 |
| 3,701,325 | 10/1972 | Fenwick | 108/152 X |
| 3,853,225 | 12/1974 | Gegauff | 248/251 X |
| 3,965,826 | 6/1976 | Markham | 108/108 X |
| 4,285,482 | 8/1981 | Follows | 248/235 |
| 4,332,361 | 6/1982 | McClellan . | |
| 4,407,476 | 10/1983 | Bohamnan | 248/235 |
| 4,426,057 | 1/1984 | Nudo | 248/235 |
| 4,498,652 | 2/1985 | Malik . | |
| 4,669,689 | 6/1987 | Jones . | |
| 4,695,020 | 9/1987 | Collins . | |
| 4,750,695 | 6/1988 | Greenhouse | 248/99 |
| 4,762,297 | 8/1988 | Milligan . | |
| 4,835,504 | 6/1989 | Bittenbinder | 248/223.4 X |
| 4,881,706 | 11/1989 | Sedlik | 248/99 |

FOREIGN PATENT DOCUMENTS

| | | | |
|---|---|---|---|
| 1168588 | 12/1958 | France | 248/251 |
| 2341290 | 10/1977 | France | 108/108 |
| 1524905 | 5/1976 | United Kingdom . | |

*Primary Examiner*—Alvin C. Chin-Shue
*Attorney, Agent, or Firm*—Sughrue, Mion, Zinn, Macpeak & Seas

[57] ABSTRACT

A container support for supporting a plastic bag having straps is formed by two plastic elongate arm members each having slots for receiving the straps. The elongate arm members are attached to a supporting surface such as a wall or the back surface of a cabinet door by using screws or the like. The arm members are formed with cavities for storing the screws such as during shipping. The arm members are formed by vertical and horizontal reinforcing ribs which are sandwiched by solid flat plastic faces. The slots have a tapering shape with bottom portions that are wider than the adjoining portion of the slot, so that the bag straps are prevented from working out of the slots. At an end of the arm members remote from the supporting surface, apertures are formed for supporting a dowel or rod or the like to support a dish towel or the like. The arm members are also adapted for receiving a plastic shelf member having legs which fit into the slots, instead of the straps of the bag.

14 Claims, 2 Drawing Sheets

CONTAINER SUPPORT WITH IMPROVED BAG HOLDING MEANS

BACKGROUND OF THE INVENTION

This invention relates to container supports in general and plastic bag supports attached to the inside wall of a cabinet door in particular.

Previous bag support systems have been supported on the ground and so take up a lot of space. Recently, it has been proposed to attach two bag supporting brackets or arms to a wall or cabinet door, and rest the plastic bag on the brackets. If a metal material is used to form the brackets, they can be heavy, easily deformable, and have sharp ends that can catch clothing or scratch flesh. In addition, it is often a problem that the handles by which the plastic bag is attached to the support work their way free due to the light weight of plastic bags, especially when little or no refuse is in the bag.

SUMMARY OF THE INVENTION

It is an object of the invention to provide a bag support made of plastic so that it can be readily mass-produced and be light in weight yet have sufficient strength to resist deformation.

It is another object of the invention to produce a bag hanger of plastic which is mountable on a wall or on a cabinet door.

It is a further object of the invention to produce a bag hanger which securely holds the handles of a plastic bag so that they cannot come loose from the support.

It is a still further object of the invention to produce a bag hanger which can readily support a dish towel and/or a small shelf, for purposes of efficiently utilizing space.

The bag support according to the present invention includes two molded plastic brackets or arms which are attachable to a wall or a cabinet door, for example, by screws. Each bracket has a solid face of plastic which is supported by vertical and horizontal plastic ribbing, so that each bracket is sturdy and has an even, minimum thickness. In each bracket, there are two slots formed so as to extend generally downwardly for purposes of holding straps or handles of the plastic bag. These slots have a widened, round bottom portion. There is also a hole formed in each bracket for supporting a dowel, so that a dish towel or the like can be hung on the dowel. One or both of the brackets can also be formed with one or more screw holding cavities for storing screws or the like when the container support is packaged.

In accordance with a further feature of the invention, the container support can function as a shelf support. A shelf member which is molded from plastic is provided with legs that are shaped to fit into the slots in the brackets.

BRIEF DESCRIPTION OF THE DRAWINGS

The above and other objects, features and advantages of the invention will be more readily apparent upon reading the detailed description set forth below, in conjunction with the accompanying drawings, in which.

DETAILED DESCRIPTION OF THE PREFERRED EMBODIMENTS

Figure 1:
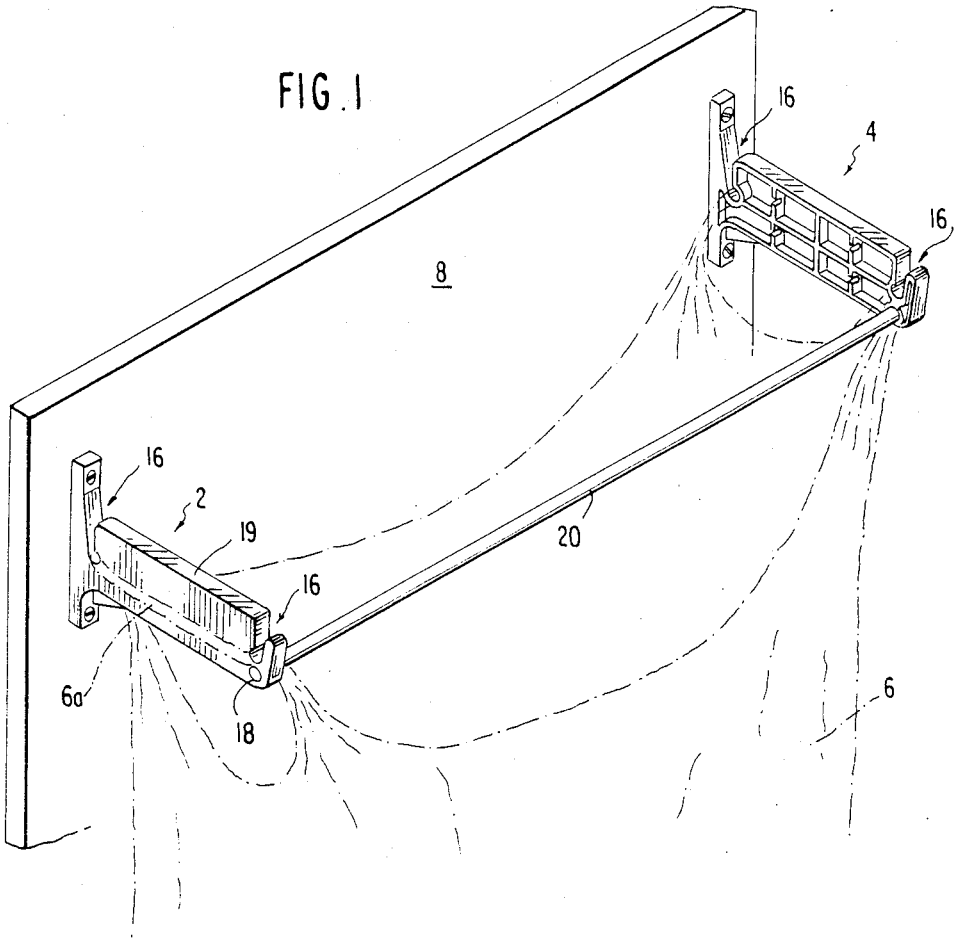
FIG. 1 is a perspective view of a container support according to the invention.
Figure 2:
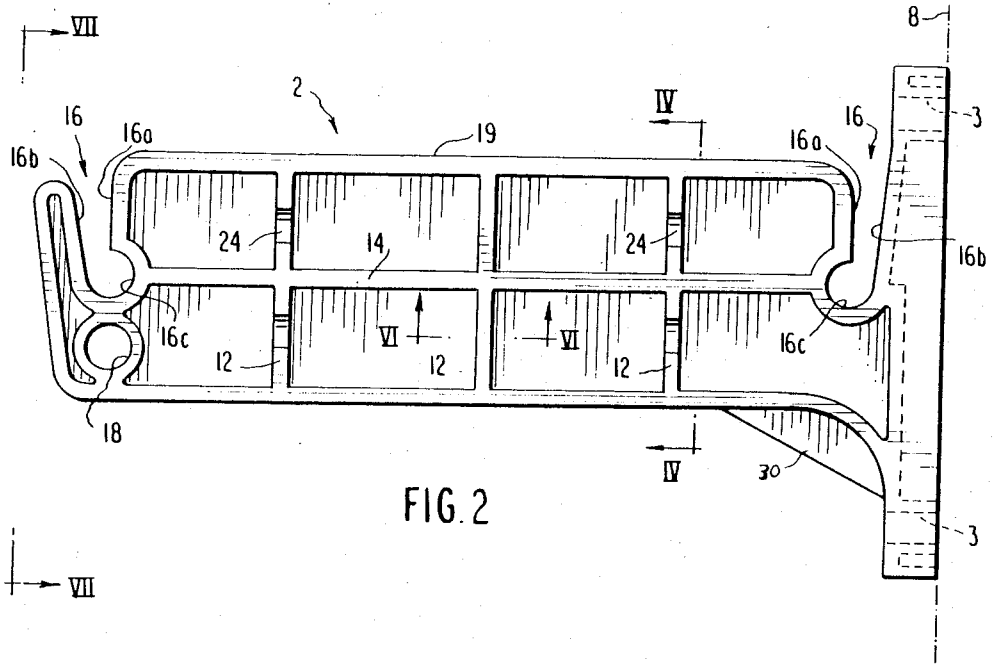
FIG. 2 is a view of a bracket of the container support of FIG 1.
Figure 6:
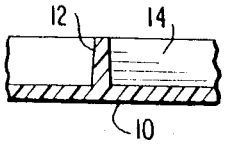
FIG. 6 is a cross-sectional view taken along a line VI—VI of a vertical rib in the bracket of FIG. 2.

The present invention is a container support formed of plastic for hanging plastic bags and the like. With reference to FIG. 1, the container support is formed by right and left brackets 2, 4, which hold a plastic bag 6, and which are secured to a door of a cabinet or a wall 8. Both the right and left brackets or arms 2, 4 are formed of plastic, such as polypropolene so that these brackets can be easily molded. The brackets 2, 4 are formed with solid faces 10, and the solid faces 10 are supported by using a rib structure having vertical ribs 12 and horizontal ribs 14, as shown in FIG. 2. The ribs 12, 14 provide a strong, rigid support for the solid faces 10, so that a minimum of plastic can be used to achieve solid faces of a minimum thickness and brackets with a minimum wall thickness. The ribbing is shown in detail in FIG. 6. In addition, a reinforcing gusset 30 (FIG. 2) can be provided.

Each bracket has two slotted holes 16 formed therein. Each slotted hole has a first substantially vertical wall **16*a* and a second wall 16*b* at an angle to the vertical wall. In addition, at the bottom of each slotted hole 16, there is a widened portion 16*c*, preferably of circular shape. In addition, it is preferable that the plane in which the substantially vertical wall 16*a* is formed lie along a diameter of the circular shape of the widened bottom portion 16*c*. Thus, the slotted holes 16 are preferably formed with a slight taper, with the top portion of the hole having the greatest width and decreasing toward the bottom portion of the hole. As is clearly shown in FIGS. 1 and 2, the two bottom portions in each arm lie in a common plane which is parallel to the longitudinal dimension of the arm so that the two bottom portions lie in a common horizontal plane when the arm is horizontally mounted on a vertical supporting surface such as the wall 8, thereby maintaining the opening of the bag 6 in a substantially horizontal plane. It is also preferable that the slotted hole nearest the wall 8 be formed with the sloping wall 16*b* closest to the wall 8, and the slotted hole furthest from the wall 8 be formed with the inclined wall 16*b* furthest from the wall 8. It is also preferable that the walls 16*a*, 16*b* of the slotted holes 16 meet the top surface 19 of the bracket with a smooth curve, as is shown for three of the four walls 16*a*, 16*b* in each bracket. Thus, the slotted holes have a narrowing gap that ends in a $\frac{3}{4}$ of a circular diameter hole with a narrow outlet. With this shape, the slotted holes 16 enable straps 6*a* of the plastic bag 6 to be easily slid into the slotted holes and down to the bottom widened portion 16*c*. This structure also helps maintain the straps at the bottom widened portions 16*c* without allowing them to ride up and out of the holes due to the narrow outlet and tapering slot to the outlet. The straps are easily removed by pulling them out of the slotted holes, which are smoothly shaped to avoid catching of and possible tearing of the straps 6*a***.

In accordance with an additional feature of the invention, each bracket 2, 4 is formed with an aperture 18 for receiving a dowel 20 or the like. The aperture 18 can be located near the end of the bracket furthest from the wall 8, e.g., adjacent and below the slotted hole so that a dish towel or the like can be hung on the dowel without interfering with the bag 6. Suitable holes for supporting a ¼" dowel would have a diameter of 0.26".

Figure 4:
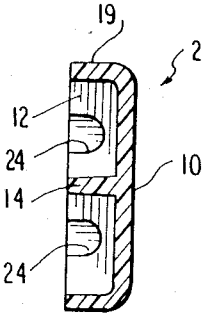
FIG. 4 is a cross-sectional view taken along a line IV—IV of a screw storing portion of the bracket of FIG. 2.

In accordance with another feature of the invention, as shown in FIG. 4, the solid faces of either or both of the brackets can be formed with cavities 24 of sufficient size, e.g., 0.168" in width, to receive the supporting screws which are used for mounting the brackets to the wall 8. The cavities have a U-shape, with the widest portion of the "U" being the point from which the width is measured. These cavities provide a convenient place for the screws to be stored prior to mounting, i.e., while the brackets are in a package, so that the screws can be easily accommodated within the package and held in place.

Figure 5:
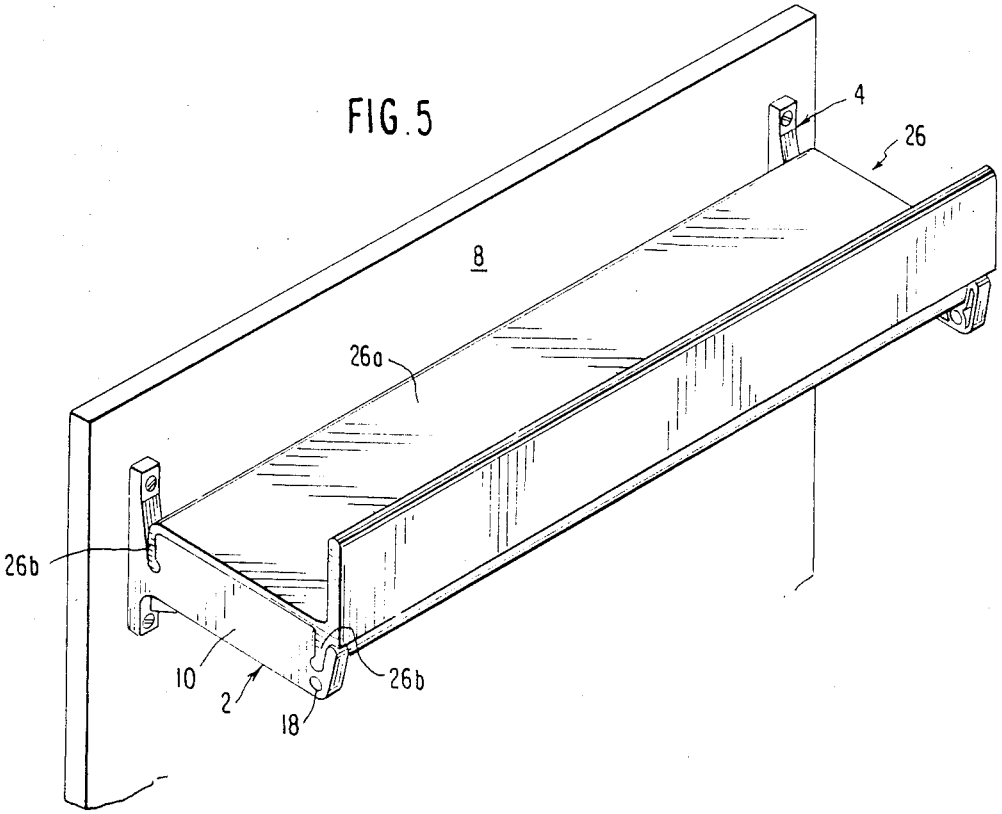
FIG 5 is a perspective view of the container support of FIG. 1 in combination with a shelf.

In accordance with a further feature of the invention, as shown in FIG. 5, the brackets 2, 4 are used to support a shelf 26, which can also be formed from molded plastic such as polypropolene. The shelf has a flat surface portion **26*a*, and leg members 26*b* which extend downward from the shelf surface and have a complementary shape to that of the slotted holes 16. Accordingly, the legs fit within the slotted holes 16 and securely support the shelf. The legs 26*b* can either be integrally molded with the rest of the shelf 26, or can be formed separately and integrally attached by a suitable fastening mechanism, such as press fitting. For example, the bottom of the shelf surface 26*a* can be provided with recesses shaped for receiving tabs formed on the top of the legs 26*b*. The end of the shelf 26 which would be positioned remote from the wall 8 can be provided with a vertically extending lip 26*c*** to keep items from falling off of the front of the shelf.

To best secure the legs into the slotted holes, the brackets should, prior to fastening them to the supporting wall, be slid with respect to the shelf in a plane parallel to the shelf's surface until the legs are accommodated in the slots. Then, the brackets are secured to the wall.

Figure 7:
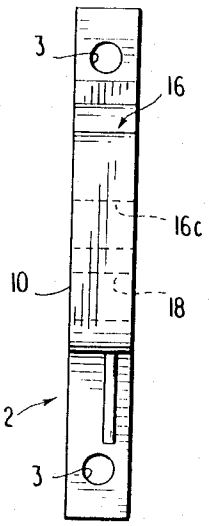
FIG. 7 is a front view of the bracket of FIG. 2.
Figure 3:
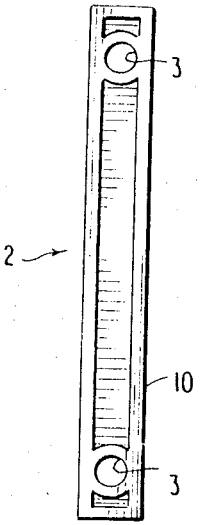
FIG 3 is an end view of a wall mounting portion of the bracket of FIG. 2.

With reference to FIG. 3, to mount the brackets 2, 4 on the wall 8, holes 3 can be provided in top and bottom portions of one end of each bracket opposite the end in which the dowel aperture 18 is formed, so that screws can be used to fasten the brackets 2, 4 to the wall 8. To provide easy access for the user who is mounting the brackets, the brackets are preferably formed with this end portion being extended above the top surface 18 of the bracket, and being extended below the main bottom surface of the bracket, as shown in FIGS. 1–2. The mounting holes 3 can also be seen in FIG. 7, which is a view of the bracket from the end opposite to that of FIG. 3.

The plastic bag holder according to the invention can easily be mass-produced, as all of its parts can be formed by molded plastic. The slotted holes which hold the straps of the plastic bag are formed so as to easily enable the straps to be guided into the holes, and easily removed therefrom, as well as to prevent the straps from coming out of the holes during usage of the plastic bag. The holder is also formed with apertures in each bracket so that a dowel can be supported therein to hold a dish towel or the like. As very often the bracket members will be mounted on the inside of a cabinet door below a sink, it is a convenient and efficient place for a dish towel to be stored. The container support according to the invention is alternatively suitable for supporting a shelf to provide for convenient storage of items thereon.

The above-described preferred embodiments of the invention are intended only to be illustrative thereof, and are not intended to limit the scope of the invention, as set forth in the appended claims.

I claim:

1. A container support for supporting a bag having straps against the downward force of gravity, said container support comprising first and second unconnected elongated rigid arm members each containing means for horizontally mounting said first and second arm members to a vertical supporting surface with said arm members extending in a lengthwise direction substantially perpendicular to said supporting surface, said first and second arm members forming a transversely extending space therebetween;

each of said arm members having a substantially flat and continuous lower surface;

wherein each of said first and second arm members has, at opposite longitudinal ends thereof, two generally downwardly extending slots formed in an upper surface of each arm member for receiving said straps of said bag, each of said slots being formed with a bottom portion means, which is wider in said lengthwise direction than a portion of said slots that is immediately upwardly adjacent to said bottom portion, for positively preventing said straps from working out of said slots and for positively preventing upward movement of a mechanical element which is transversely inserted into both of said slots of both of said arm members and which is complementary in shape to that of said slots; and wherein the bottom portion means of the slots in each arm member lie in a common plane which is parallel to the longitudinal dimension of the arm member so that the bottom portions of both arm members lie in a common horizontal plane when the arm members are horizontally mounted on a vertical supporting surface;

said container support further comprising a removable shelf member having leg means, with a shape complementary to that of said slots and bottom portion means in each of said arm members, for securely supporting said shelf member in and on said arm members in such a manner that, after said leg means are transversely inserted into said slots, said shelf member is locked against upward movement thereof.

2. The container support of claim 1, wherein said bottom portion means of said slots has a circular shape.

3. The container support of claim 2, wherein said slots taper downwardly in width until said bottom portion means.

4. The container support of claim 3, wherein one side wall of said slots extends vertically, and the other side wall is inclined at an acute angle to the one side wall.

5. The container support of claim 1, wherein said arm members each have an aperture means formed therein for receiving respective opposite ends of an elongated towel-supporting rod, each said aperture means being formed proximate to one of said slots which is at the opposite longitudinal end furthest from a vertical supporting surface when said each arm member is horizontally mounted on the vertical supporting surface.

6. The container support of claim 1, wherein said arm members are rigid plastic members.

7. The container support of claim 1, wherein said means for mounting said arm members comprises screws, and at least one of said arm members has a cavity means formed therein for storing said screws before mounting of said arm members.

8. The container support of claim 5, wherein said shelf member has an upwardly extending lip portion along an end thereof which is perpendicular to said lengthwise direction and remote from said supporting surface with respect to said lengthwise direction.

9. The container support of claim 8, wherein said shelf member is formed of molded plastic.

10. The container support of claim 4, wherein each of said arm members has a substantially flat solid face on one side thereof, and wherein each of said arm members comprises rigidizing ribs on the other side thereof for rigidly supporting said solid face.

11. The container support of claim 10, wherein said ribs extend longitudinally and transversely of each arm member.

12. The container support of claim 11, wherein said ribs comprise at least three transverse ribs and at least one horizontal rib.

13. The container support of claim 5, further comprising an elongated rod having opposite ends which are respectively received in said aperture means formed in said arm members.

14. A container support for supporting a bag having straps against the downward force of gravity, said container support comprising first and second unconnected elongated arm members each containing means for horizontally mounting said first and second arm members to a vertical supporting surface with said arm members extending in a lengthwise direction substantially perpendicular to said supporting surface;

wherein each of said first and second arm members has, at opposite longitudinal ends thereof, two generally downwardly extending slots formed therein for receiving said straps of said bag, each of said slots being formed with a bottom portion which is wider in said lengthwise direction than a portion of said slots adjacent to said bottom portion for positively preventing said straps from working out of said slots;

wherein said bottom portion of said slots has a circular shape;

wherein said slots taper downwardly in width until said bottom portion;

wherein one side wall of said slots extends vertically, and the other side wall is inclined at an acute angle to the one side wall; and wherein said one side wall of each of said slots is aligned with a vertical diameter of said circular shape, and wherein the other side walls of the slots in each arm member are inclined in opposite directions;

said container support further comprising a removable shelf member having leg means, with a shape complementary to that of said slots and bottom portion means in each of said arm members, for securely supporting said shelf member in and on said arm members in such a manner that, after said leg means are transversely inserted into said slots, said shelf member is locked against upward movement thereof.

* * * * *

UNITED STATES PATENT AND TRADEMARK OFFICE

CERTIFICATE OF CORRECTION

PATENT NO. : 4,984,759
DATED : Jan. 15, 1991
INVENTOR(S) : Sigmund Berlant

It is certified that error appears in the above-identified patent and that said Letters Patent is hereby corrected as shown below:

The title page should be deleted to appear as per attached.

Signed and Sealed this

Seventh Day of April, 1998

Bruce Lehman

*Attest:*

BRUCE LEHMAN

*Attesting Officer*

*Commissioner of Patents and Trademarks*

United States Patent [19]

Berlant

[11] Patent Number: 4,984,759

[45] Date of Patent: Jan. 15, 1991

[54] CONTAINER SUPPORT WITH IMPROVED BAG HOLDING MEANS

[76] Inventors: Sigmund Berlant, 1332 NW. 14 Ave., Pompano Beach, Fla. 33069

[21] Appl. No.: 326,765

[22] Filed: Mar. 21, 1989

[51] Int. Cl.[5] ..... B65B 67/04; A47F 5/00

[52] U.S. Cl. ..... 248/99; 248/235; 248/250; 211/90; 108/152; 108/108

[58] Field of Search ..... 248/95-101, 248/235, 251, 252, 247; 108/108, 152; 211/90, 186

[56] References Cited

U.S. PATENT DOCUMENTS

| | | | |
|---|---|---|---|
| 774,968 | 11/1909 | McKee | 248/251 |
| 1516,451 | 11/1924 | McKenzie | 248/97 |
| 2,875,970 | 6/1956 | Gardner . | |
| 2,900,085 | 8/1959 | Levy | 248/250 X |
| 3,284,040 | 11/1966 | Marontate | 211/90 X |
| 3,484,816 | 12/1969 | Boss | 108/152 |
| 3,701,325 | 10/1972 | Fenwick | 108/152 X |
| 3,853,225 | 12/1974 | Gegauff | 248/251 X |
| 3,965,826 | 6/1976 | Markham | 108/108 X |
| 4,285,482 | 8/1981 | Follows | 248/235 |
| 4,332,361 | 6/1982 | McClellan . | |
| 4,407,476 | 10/1983 | Bohamnan | 248/235 |
| 4,426,057 | 1/1984 | Nudo | 248/235 |
| 4,498,652 | 2/1985 | Malik . | |
| 4,669,689 | 6/1987 | Jones . | |
| 4,695,020 | 9/1987 | Collins . | |
| 4,750,695 | 6/1988 | Greenhouse | 248/99 |
| 4,762,297 | 8/1988 | Milligan . | |
| 4,835,504 | 6/1989 | Bittenbinder | 248/223.4 X |
| 4,881,706 | 11/1989 | Sedlik | 248/99 |

FOREIGN PATENT DOCUMENTS

| | | | |
|---|---|---|---|
| 1168588 | 12/1958 | France | 248/251 |
| 2341290 | 10/1977 | France | 108/108 |
| 1524905 | 5/1976 | United Kingdom . | |

*Primary Examiner*—Alvin C. Chin-Shue
*Attorney, Agent, or Firm*—Sughrue, Mion, Zinn, Macpeak & Seas

[57] ABSTRACT

A container support for supporting a plastic bag having straps is formed by two plastic elongate arm members each having slots for receiving the straps. The elongate arm members are attached to a supporting surface such as a wall or the back surface of a cabinet door by using screws or the like. The arm members are formed with cavities for storing the screws such as during shipping. The arm members are formed by vertical and horizontal reinforcing ribs which are sandwiched by solid flat plastic faces. The slots have a tapering shape with bottom portions that are wider than the adjoining portion of the slot, so that the bag straps are prevented from working out of the slots. At an end of the arm members remote from the supporting surface, apertures are formed for supporting a dowel or rod or the like to support a dish towel or the like. The arm members are also adapted for receiving a plastic shelf member having legs which fit into the slots, instead of the straps of the bag.

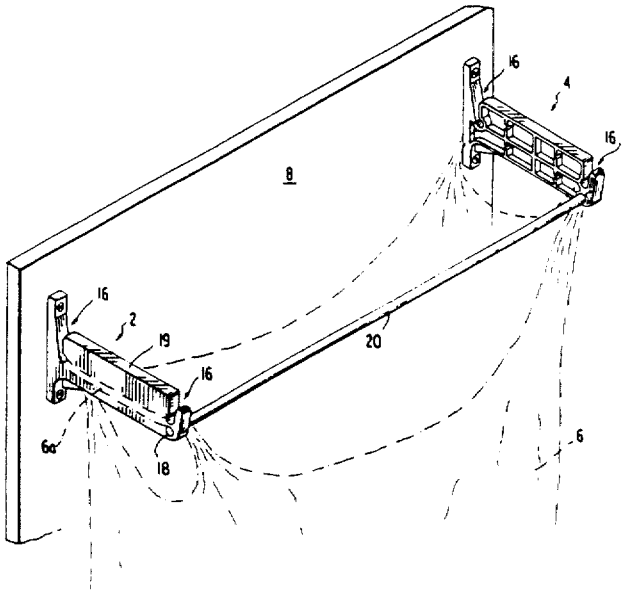

14 Claims, 2 Drawing Sheets